United States Patent [19]

Maes

[11] Patent Number: 4,493,397

[45] Date of Patent: Jan. 15, 1985

[54] FORK LIFT TRUCKS

[75] Inventor: George L. Maes, Collierville, Tenn.

[73] Assignee: Nissan Industrial Equipment Co., Memphis, Tenn.

[21] Appl. No.: 405,895

[22] Filed: Aug. 6, 1982

[51] Int. Cl.[3] ..... B66B 9/20

[52] U.S. Cl. ..... 187/9 E; 254/277

[58] Field of Search ..... 187/9 E; 414/592; 254/277, 364; 242/55 R; 267/124, 167, 136

[56] References Cited

U.S. PATENT DOCUMENTS

| | | | |
|---|---|---|---|
| 2,667,333 | 1/1954 | Martin | 254/277 |
| 2,941,684 | 6/1960 | Quayle | 414/592 |
| 3,252,545 | 5/1966 | Quayle | 187/9 E |
| 3,481,498 | 12/1969 | Sturtz | 414/592 |
| 3,651,891 | 3/1972 | Pittaluga | 187/9 E |
| 3,894,616 | 7/1975 | Kawanishi et al. | 187/9 E |
| 4,244,449 | 1/1981 | Renk et al. | 187/9 E |

*Primary Examiner*—Joseph J. Rolla
*Assistant Examiner*—Kenneth Noland
*Attorney, Agent, or Firm*—Walker & McKenzie

[57] ABSTRACT

An improved fork lift truck of the type having a telescopic mast assembly whereby proper tension is maintained on a section of hydraulic lines extending from a source of pressurized hydraulic fluid to a carrier member of the mast assembly to which various hydraulic units can be attached. The improvement includes sheave structure for guidingly receiving the section of the hydraulic lines and mounting structure for mounting the sheave structure to the mast assembly in such a manner that the section of hydraulic lines is substantially maintained within the confines of the mast assembly regardless of the position of the mast assembly.

3 Claims, 11 Drawing Figures

FORK LIFT TRUCKS

BACKGROUND OF THE INVENTION

1. Field of the Invention

This invention relates to an improvement in fork lift trucks of the type having a telescopic mast assembly and hydraulic lines going to a carrier member of the mast assembly for operating various hydraulic attachment units that can be attached to the carrier member.

2. Description of the Prior Art

The following U.S. Patents relate, in general, to the present invention: Backofen, U.S. Pat. No. 2,611,497; Quayle, U.S. Pat. No. 2,941,684; Quayle, U.S. Pat. No. 2,979,162; Pi, U.S. Pat. No. 3,462,028; Sturtz, U.S. Pat. No. 3,481,498; Pi, U.S. Pat. No. 3,491,905; and Renk, U.S. Pat. No. 4,244,449. None of the above patents disclose or suggest the present invention.

A major problem with fork lift trucks having extendible, telescopic mast assemblies of the type here involved is the protection of the hydraulic lines going to the carrier member as the mast assembly is raised or lowered and/or as the truck is moved about. Typical prior art structures include a combination of reels, sheaves and the like which cause a portion of the hydraulic lines, to a greater or lesser extent, to be at least temporarily positioned outside of the mast structure (see, for example, the above-cited Renk 4,244,449 patent).

SUMMARY OF THE INVENTION

The present invention is directed toward improving upon prior fork lift trucks and the like. A concept of the present invention is to provide a fork lift truck with means for guidingly receiving a section of the hydraulic lines going to the carrier member in such a manner that the section of the hydraulic lines is substantially maintained within the confines of the mast assembly as the carrier unit is raised and lowered. Another concept of the present invention is to provide a fork lift truck with enclosed means for properly automatically tensioning the hydraulic lines.

The improved fork lift truck of the present invention includes a truck assembly; a telescopic mast assembly for being attached to the truck assembly and having a carrier member to which various hydraulic attachments can be attached and having a lift means for moving the carrier member with respect to the truck assembly; a source of pressurized hydraulic fluid; and a hydraulic line assembly extending between the source of pressurized hydraulic fluid and the carrier member. The improvement of the present invention comprises a sheave means for guidingly receiving a section of the hydraulic line assembly and for being attached to the mast assembly in such a manner that the section of the hydraulic line assembly is maintained substantially within the confines of the mast assembly as the carrier member is moved.

DESCRIPTION OF THE PREFERRED EMBODIMENT

Figure 1:
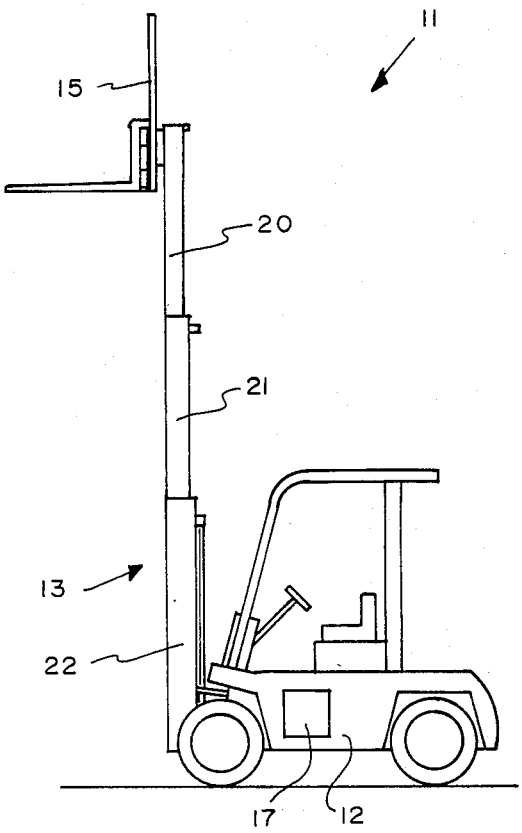
FIG. 1 is a side elevational view of a fork lift truck including the improvement of the present invention.
Figure 2:
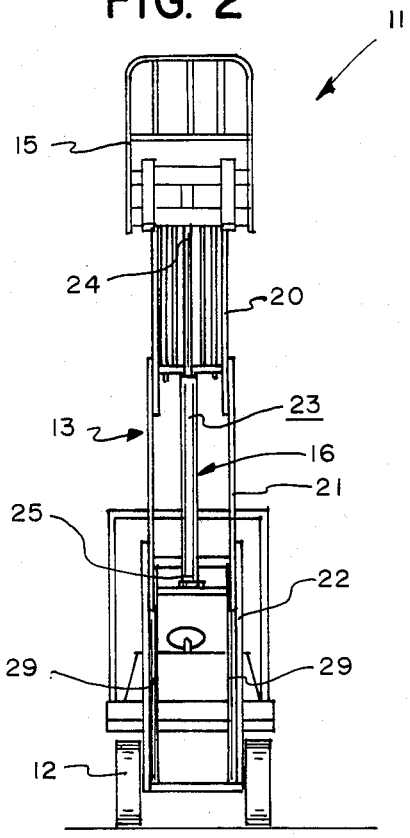
FIG. 2 is a front elevational view of FIG. 1.
Figure 3:
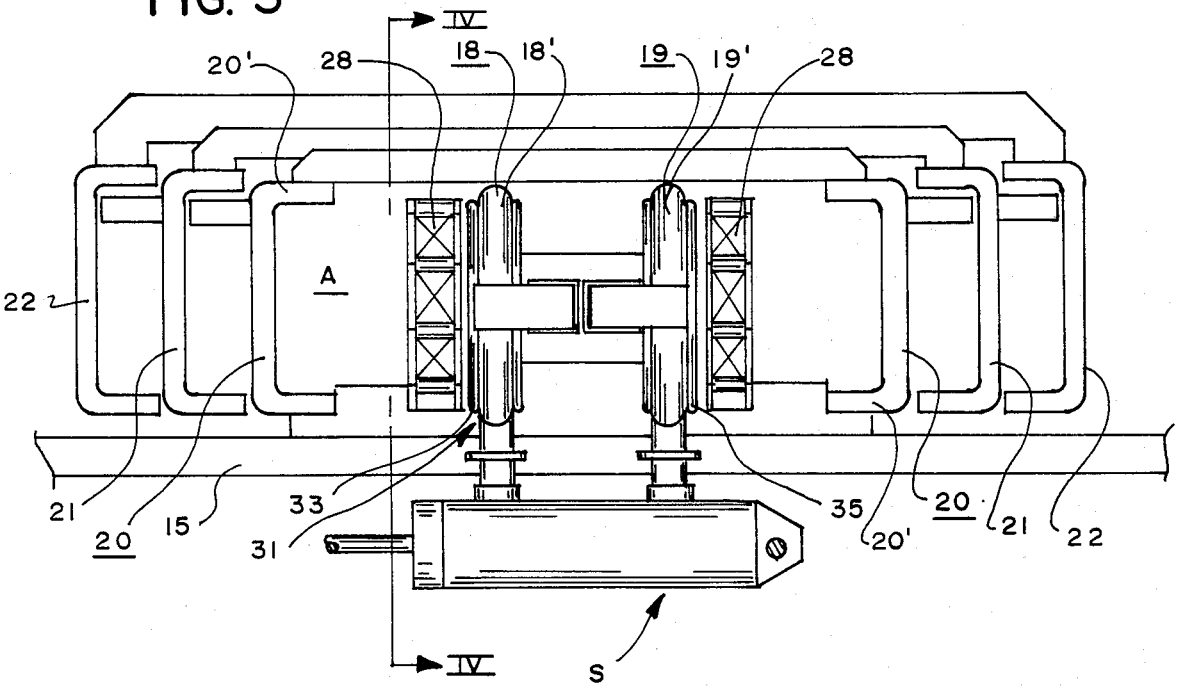
FIG. 3 is an enlarged top plan view of a portion of FIG. 2.
Figure 4:
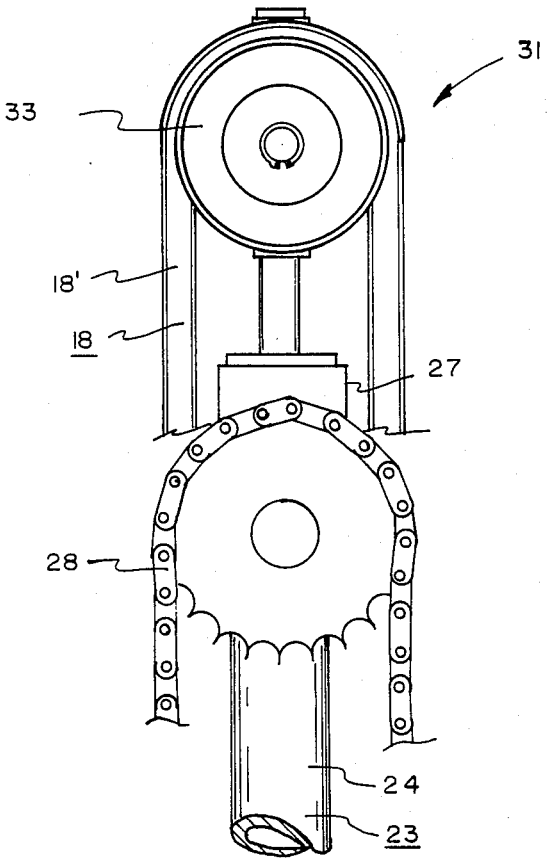
FIG. 4 is a sectional view as taken on line IV—IV of FIG. 3 with portion thereof broken away for clarity.
Figure 5:
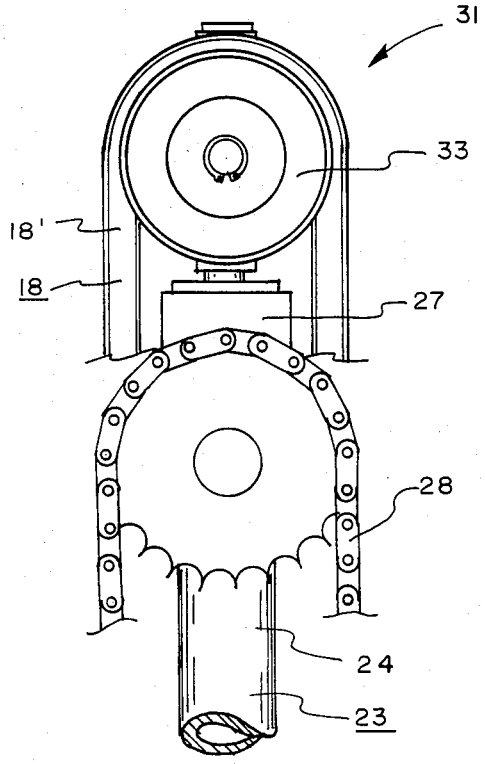
FIG. 5 is a sectional view similar to FIG. 4 but with portions thereof shown in a moved position.

The improved fork lift truck 11 of the present invention (see, in general, FIGS. 1 and 2) is preferably of the triplex, or triple section, extendible mast type including a truck assembly 12; including a telescopic mast assembly 13 for being attached to the truck assembly 12, the mast assembly having a carrier member 15 to which various hydraulic attachment units, such as the side sifter S shown diagrammatically in FIG. 3, can be attached and having a lift means 16 for moving the carrier member 15 with respect to the truck assembly 12; including a source of pressurized hydraulic fluid 17; and including a hydraulic line assembly such as a pair of hydraulic lines 18, 19 extending between the source of pressurized hydraulic fluid 17 and the carrier member 15. The mast assembly 13 preferably includes a first or inner most member 20 to which the carrier member 15 is slidably attached, a second or intermediate mast member 21 to which the first mast member 20 is slidably attached, and a third or outer mast member 22 to which the second mast member 21 is slidably attached and which is attached to the truck assembly 12. The construction and operation of the mast members 20, 21, 22 are typical and well-known to those skilled in the art.

The lift means 16 preferably includes a hydraulic piston 23 for being operatively positioned between the first and second mast members 20, 21 for causing the first mast member 20 and the carrier member 15 to move relative to the second mast member 21. The piston 23 includes a first end 24 and a second end 25. The second end 25 of the piston 23 is preferably attached to the second mast member 21. The first end 24 of the piston 23 preferably includes a head member 27 which is operably coupled to both the carrier member 15 and first mast member 20 by way of chains 28 with one end attached to the carrier member 15 and the other end attached to the first mast member 20 in the usual manner whereby movement of the piston 23 will cause movement of both the carrier member 15 and mast member 20 with respect to the second mast member 21, preferably at an increased ratio with regards to the movement of the piston 23 (e.g., at a 2:1 ratio).

The mast assembly 13 preferably includes hydraulic pistons 29 operatively positioned between the second and third mast members 21, 22 for causing the second mast member 21, and thus the first mast member 20 and carrier member 15, to move relative to the third mast member 22.

When the mast assembly 13 is viewed in plan, such as in FIG. 3, it will be noted that the mast members 20, 21, 22 have side members formed of inwardly directed channels to form a nesting arrangement with one another, and with the first mast member 20 located innermost and with the side members 20' thereof coacting to generally define a confinement area A which is of importance to the present invention for reasons which will hereinafter become apparent. Various other hydraulic lines, chains and the like may be provided on the mast assembly 13 and between the mast assembly 13 and truck assembly 12 for proper operation of the fork lift truck 11. However, the general construction and operation of the fork lift truck 11 is typical and well-known to those skilled in the art and does not require a detailed description for the purposes of the present invention. Thus, for example, the above cited Quayle U.S. Pat. No. 2,941,684 and Sturtz U.S. Pat. No. 3,481,498 patents disclose fork lift trucks having triplex telescopic mast assemblies.

Figure 11:
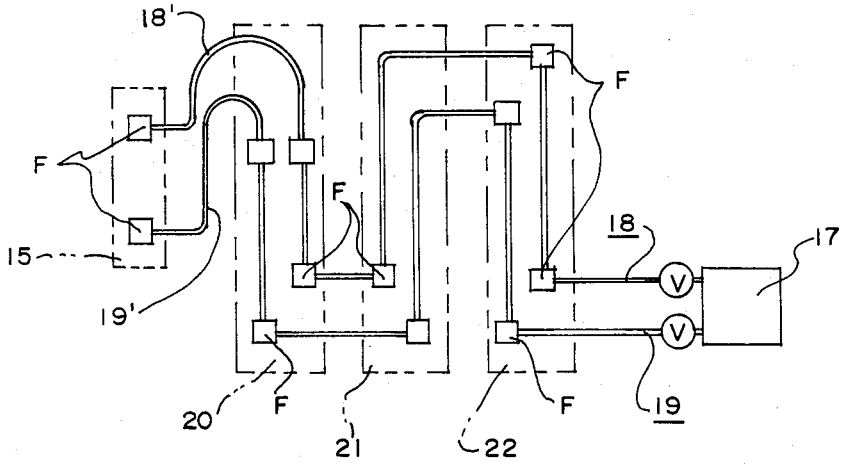
FIG. 11 is a diagrammatic view of certain portions of the hydraulic layout of the fork lift truck of the present invention.
Figure 6:
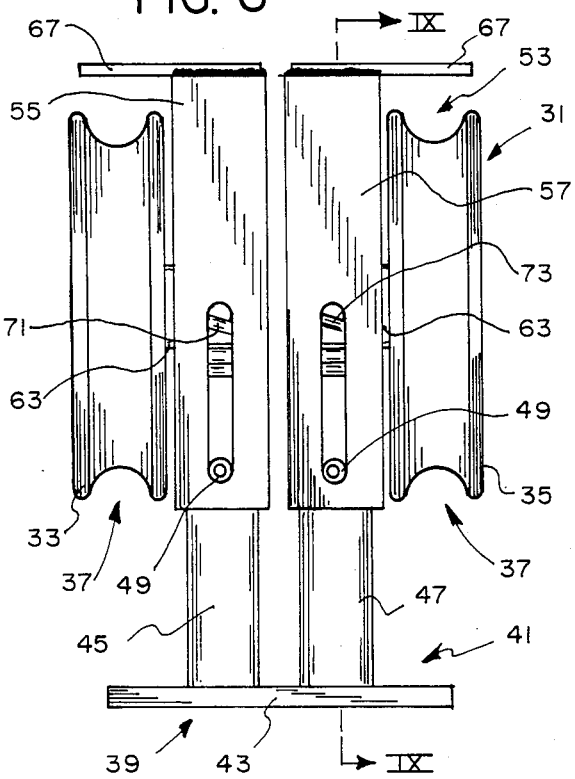
FIG. 6 is a front elevational view of the preferred embodiment of the structure of the improvement of the present invention.
Figure 7:
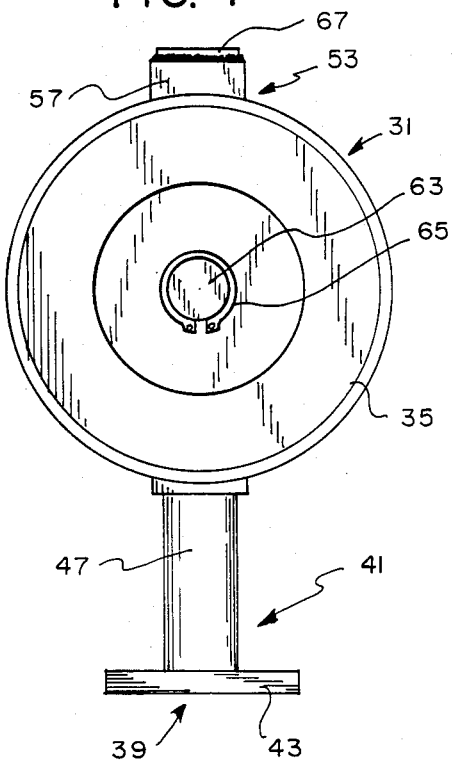
FIG. 7 is a right side elevational view of FIG. 6.
Figure 8:
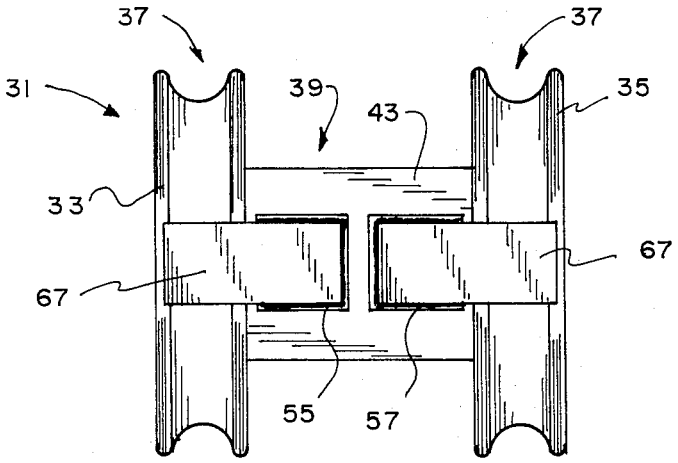
FIG. 8 is a top plan view of FIG. 6.
Figure 9:
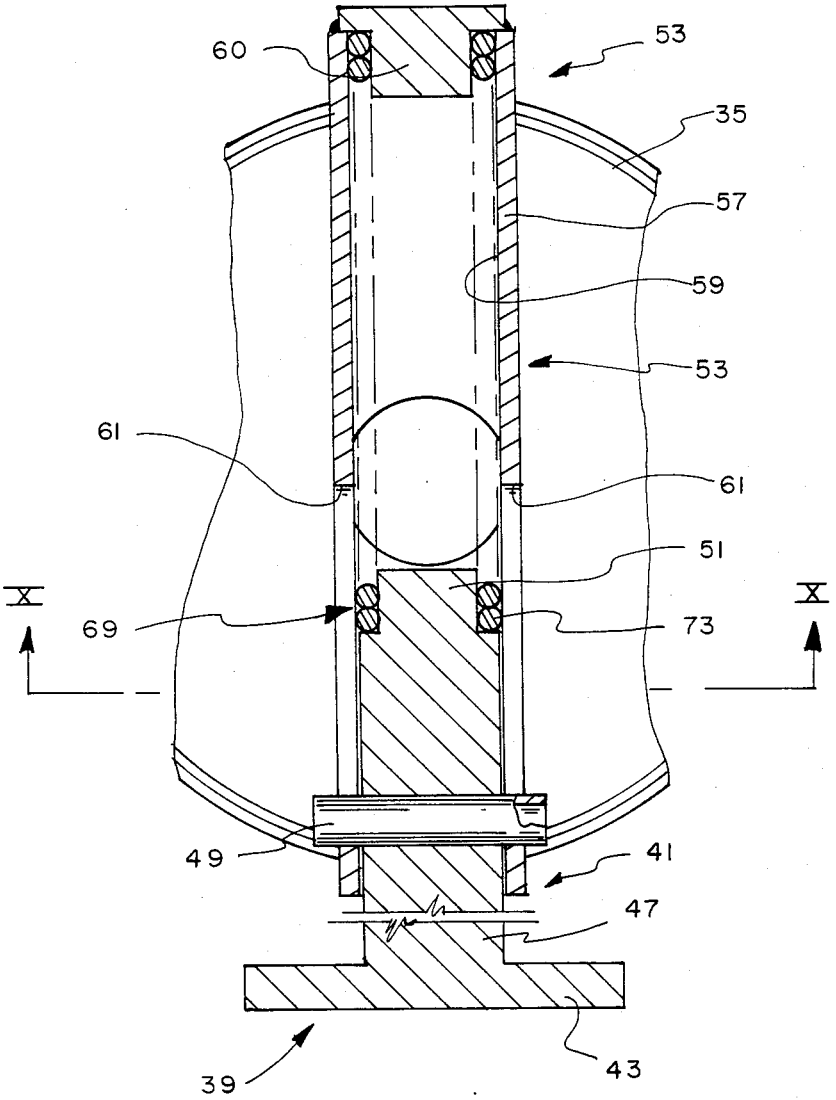
FIG. 9 is an enlarged sectional view as taken on line IX—IX of FIG. 6 with portions thereof broken away for clarity.

It should be noted that the improvement of the present invention principally concerns the flexible sections 18', 19' of the hydraulic lines 18, 19 that extend between the carrier member 15 and first mast member 20. Thus, as shown diagrammatically in FIG. 11, each hydraulic line 18, 19 includes a number of sections for extending from the source 17 of pressurized hydraulic fluid to the carrier member 15 through typical control valves V or the like and a number of fittings F or the like for providing hydraulic fluid to the attachment unit such as the side shifter S. Certain sections of the lines 18, 19 may be rigid and other sections must be flexible. The specific construction, lay-out and operation of the lines 18, 19 is typical and well-known to those skilled in the art.

The improvement of the present invention relates to an arrangement whereby the hydraulic assembly, that is, the hydraulic lines 18, 19 can be maintained under proper tension and within the confines of the mast assembly 13 (i.e., generally within the area A) as the first mast member 20 is raised and lowered with respect to the second mast 21 thus protecting the hydraulic lines 18, 19 from damage, etc.

The improvement of the present invention may include a tensioning or guiding means for maintaining proper tension on the portions or sections 18', 19' of the hydraulic lines 18, 19 that extend from the first mast member 20 to the carrier member 13 as the piston 23 causes movement of the first mast member 20 and carrier member 13 with respect to the second mast member 21. More specifically, the improvement of the present invention includes sheave means 31 (see, in general, FIGS. 3–6) for guidingly receiving the hydraulic line assembly. The sheave means 31 preferably includes a first sheave member 33 for guidingly receiving the section 18' of the hydraulic line 18 and a second sheave member 35 for guidingly receiving the section 19' of the hydraulic line 19. Each sheave member 33, 35 preferably includes a groove portion 37 for coating with the hydraulic lines 18, 19. The sheave members 33, 35 may be of typical construction well-known to those skilled in the art for attachment to an axle or the like. The sheave means 31 is attached to the mast assembly 13 in such a manner that the sections 18', 19' of the hydraulic lines 18, 19 are substantially maintained within the confines of the mast assembly 13 (i.e., generally within the area A) as the carrier member 15 is moved.

The improvement of the present invention also preferably includes mounting means 39 (see, in general, FIGS. 6–9) for mounting the sheave means 31 to the first end 24 of the piston 23. The mounting means 39 preferably includes a body member 41 for being operatively attached to the first end 24 of the piston 23. The body member 41 preferably includes a base portion 43 for being fixedly attached to the head member 27 of the first end 24 of the piston 23 by suitable means well-known to those skilled in the art such as by welding, a first upwardly directed body portion 45 fixedly attached to the base portion 43, and a second upwardly directed body portion 47 fixedly attached to the base portion 43. The first and second body portions 45, 47 are preferably post-like members mounted side-by-side on the base portion 43 a spaced-apart distance. Each body portion 45, 47 preferably includes an outwardly directed pin member 49 and an upwardly directed boss portion 51, both for reasons which will hereinafter become apparent.

The mounting means 39 also preferably includes a head member 53. The head member 53 preferably includes a first head portion 55 slidably mounted on the first body portion 45, and a second head portion 57 slidably on the second body portion 47. Each of the first and second head portions 55, 57 preferably has a downwardly directed cavity 59 for receiving the upper end of the first or second body portion 45, 47 respectively. Each cavity 59 preferably includes a downwardly directed boss portion 60 for reasons which will hereinafter become apparent. Each of the first and second head portions 55, 57 also preferably has an elongated, vertically extending aperture 61 opening into the cavity 59 thereof for reasons which will hereinafter become apparent. Each head portion 55, 57 preferably includes an outwardly extending, axle-like arm 63 for receiving the first or second sheave member 33, 35 respectively. A retaining member 65 (See FIGS. 7 and 10) may be provided to secure each sheave member 33, 35 to the respective arm 63 in any manner as will now be apparent to those skilled in the art. An outward extension 67 may be provided on the upper end of each head portion 55, 57 for holding the hydraulic lines 18, 19 against the sheave members 33, 35.

The mounting means 39 preferably includes an enclosed or integral spring means 69 for normally urging the head member 53 away from the body member 41 and the first end 24 of the piston 23. The spring means 69 preferably includes a first spring member 71 positioned substantially between the first body portion 45 and the first head portion 55 and preferably includes a second spring member 73 substantially positioned between the second body portion 47 and the second head portion 57. The opposite ends of the spring members 71, 73 may fit about the base portions 51, 60 of the body portion 45, 47 and head 55, 57 to aid the spring members 71, 73 in maintaining proper alignment within the cavities 59.

Figure 10:
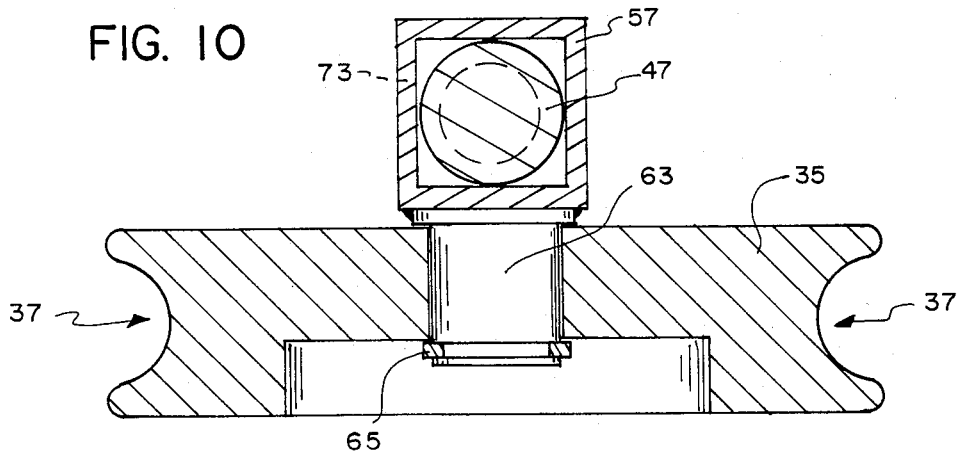
FIG. 10 is a sectional view as taken on line X—X of FIG. 9.

The body portions 45, 47, head portions 55, 57 and spring members 71, 73 are sized and shaped so as to coact with one another (i.e., so that the body members 45, 47 and spring members 71, 73 will slidably fit within the cavities 59 in the head portions 55, 57 thereby enclosing the spring members 71, 73 within the body portions 45, 47 and head portions 55, 57). The body portions 45, 47 and spring members 71, 73 may be generally circular when viewed in plan as shown in FIG. 10 while the head portions 55, 57 and cavities 59 may be generally square when viewed in plan as shown in FIG. 10.

When mounting means 39 is properly assembled, the pin members 49 of the body portions 45, 47 are trapped within the apertures 61 of the head portions 55, 57 respectively whereby the respective head portions 55, 57 are maintained in proper alignment with the respective body portions 45, 47 and whereby the movement of the respective head portions 55, 57 with respect to the respective body portions 45, 47 is limited.

It should be noted that the first and second head portions 55, 57 are not directly coupled to one another and, therefore, move on the first and second body portions 45, 47 independently of one another.

As thus constructed, the use of the improvement of the present invention is automatic as the carrier member 15 and/or first mast member 20 is moved with respect to the second or third mast members 21, 22. The improvement provides proper guidance and tensioning of the sections 18', 19' of hydraulic lines 18, 19 as they pass between the first mast member 20 and carrier member 15. The structure of the present invention acts independently on each hydraulic line 18, 19 and acts as a shock absorber, preventing any "water hammer" effect on the hydraulic lines 18, 19 and increasing the life of the hydraulic lines 18, 19 on the various fittings on the hydraulic lines 18, 19.

Although the invention has been described and illustrated with respect to a preferred embodiment thereof, it is not to be so limited since changes and modifications may be made therein which are within the full intended scope of the invention.

I claim:

1. A tensioning device for maintaining proper tension on a section of the hydraulic lines of a fork lift truck having a truck assembly; having a telescopic mast assembly, including a first mast member, a second mast member to which said first mast member is slidably attached, and a third mast member to which said second mast member is slidably attached and which is attached to said truck assembly; and having a piston including a first end for being operatively attached to said first mast member and including a second end for being operatively attached to said second mast member, said tensioning device comprising:

(a) sheave means for guidingly receiving said section of said hydraulic lines; and (b) mounting means for mounting said sheave means to said first end of said piston of said telescopic mast assembly in such a manner that said section of said hydraulic lines is substantially maintained within the confines of said telescopic mast assembly regardless of the position of the mast assembly; said mounting means including a body member attached to said telescopic mast assembly, said body member including a first upwardly directed body portion and a second upwardly directed body portion; said mounting means including a head member, said head member including a first head portion slidably mounted on said first body portion and including a second head portion slidably mounted on said second body portion; said mounting means including a first spring member positioned between said first body portion and said first head portion, and a second spring member positioned between said second body portion and said second head portion, said first and second spring members being enclosed within said first and second head portions respectively.

2. The tensioning device of claim 1 in which each of said first and second head portions has a cavity for receiving the upper end of said first or second body portion respectively, said first and second spring members being positioned within said cavity of said first or second head portion.

3. The tensioning device of claim 2 in which each of said first and second head portions has an elongated, vertically extending aperture opening into said cavity thereof; and in which each of said first and second body portions has a pin member extending through said aperture in said first or second head portion respectively for maintaining said respective head portion in proper alignment with said respective body portion and for limiting the movement of said respective head portion with respect to said respective body portion.

* * * * *